United States Patent [19]

Reba

[11] 4,267,795

[45] May 19, 1981

[54] LIQUID DISTRIBUTING APPARATUS

[75] Inventor: Imants Reba, Vancouver, Wash.

[73] Assignee: Crown Zellerbach Corporation, San Francisco, Calif.

[21] Appl. No.: 148,111

[22] Filed: May 9, 1980

[51] Int. Cl.[3] ..... B05C 1/04; B05C 3/18; B05C 5/00

[52] U.S. Cl. ..... 118/302; 118/314; 118/315; 118/325; 118/DIG. 4; 427/420

[58] Field of Search ..... 118/DIG. 4, 324, 325, 118/300, 302, 314, 315; 427/420

[56] References Cited

U.S. PATENT DOCUMENTS

| | | | |
|---|---|---|---|
| 2,745,419 | 5/1956 | Slingerland | 118/DIG. 4 |
| 3,249,304 | 5/1966 | Faro et al. | 118/302 X |
| 3,345,972 | 10/1967 | Masulis | 118/DIG. 4 |
| 3,365,325 | 1/1968 | Fraenkel et al. | 118/324 X |
| 3,654,896 | 4/1972 | Marx | 118/DIG. 4 |
| 3,973,062 | 8/1976 | Fahrni | 118/DIG. 8 |
| 3,986,476 | 10/1976 | Yano et al. | 118/DIG. 4 |

*Primary Examiner*—Shrive P. Beck
*Attorney, Agent, or Firm*—Thomas R. Lampe

[57] ABSTRACT

Apparatus for uniformly distributing liquid to a moving web or the like including a housing having side walls with elongated liquid exit slits formed therein. Curved deflector plates are positioned adjacent to the exit slits to direct fluid exiting therefrom toward the moving web. Baffles are provided within the housing defining openings through which the liquid must pass prior to exiting from the exit slits. The baffles are positioned in such a manner as to agitate the liquid prior to its reaching the exit slits.

6 Claims, 4 Drawing Figures

LIQUID DISTRIBUTING APPARATUS

BACKGROUND OF THE INVENTION

The present invention relates to a liquid distributing apparatus, and more particularly, to apparatus having application in the tissue manufacturing art. Tissue machine configurations often incorporate pick-up felts for transferring the web through the various stages of manufacture. It is necessary that web pick-up be accomplished at high paper machine speeds and transfer to a pick-up felt, especially from the forming wire, requires good water distribution on the felt. Poor distribution manifests itself in streaks creating a pattern readily detectable in a pick-up felt and on the surface of the yankee conventionally employed downstream.

Poor water distribution on the pick-up felt in tissue-making machines is a common problem. Apparently, the problem is caused by the inherent inability of conventional spray nozzles to produce a uniform liquid coverage on the felt surface. In addition, dry streaks are readily produced since nozzles plug easily, particularly since felts are often wetted with the "white water" which contains fiber often in the forms of knits.

Rather than employ nozzles, sheet-like flow discharges can be generated in a number of other ways, the simpliest and most obvious being a discharge through a narrow slit. The only requirements are that the liquid supply has a uniform head (pressure) along the slit and that no particles are permitted to plug the slit. The latter limitation is a very important constraint since any particle blocking the slit causes immediate rupture of the liquid sheet subsequently causing a wide unwetted streak on the target surface. Simple downwardly discharging slits have been found impractical for the continuous formation of sheet-like flow discharges since gravity aids formation of deposits in the slit and cleaning thereof is difficult.

It is therefore an object of the present invention to provide apparatus which is simple and economical in construction and yet is free of the plugging and other problems associated with prior art devices as set forth above.

SUMMARY OF THE INVENTION

According to the present invention a housing is provided having elongated slits in the side walls thereof. The "white water" or other liquid in the housing is pressurized in the vicinity of the slits and exits the housing therethrough under a relatively high discharge velocity. After exiting from the slits the liquid contacts curved liquid deflection plates extending along the length of the housing. The deflection plates change the path of the liquid from a generally horizontal direction to a generally vertical direction toward the target surface. Baffles are provided within the housing defining openings through which the liquid must pass prior to the liquid exiting from the slits. The baffles are configured and positioned so as to produce agitation within the liquid and break up fiber flocks.

Other objects and characteristics of the invention will be apparent from the following more detailed description and accompanying drawings in which:

DETAILED DESCRIPTION

Figure 1:
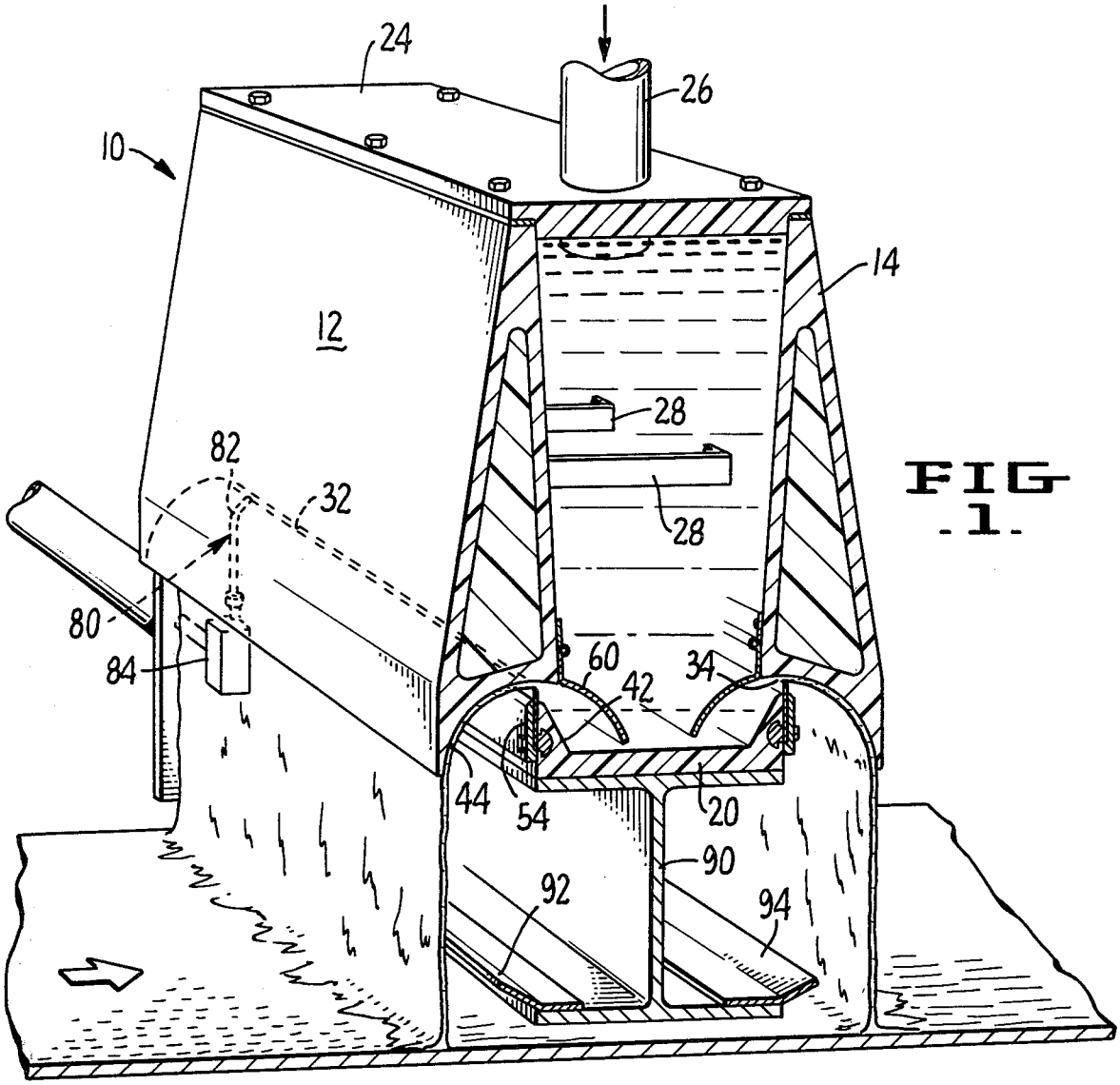
FIG. 1 is a sectional isometric view of apparatus constructed in accordance with the teachings of the present invention in operative association with a pick-up felt to be wetted thereby.
Figure 2:
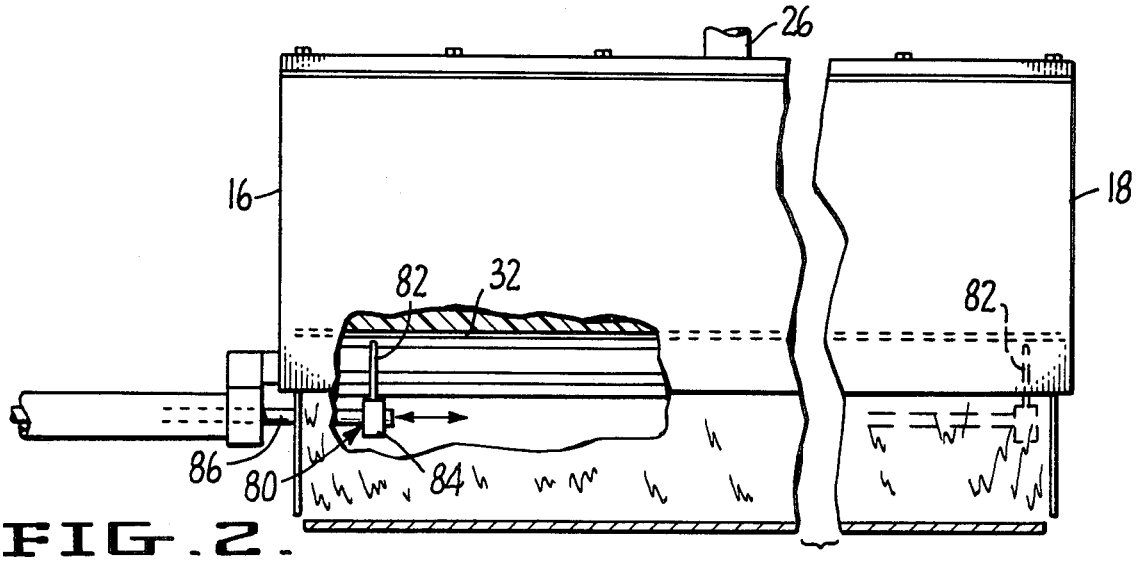
FIG. 2 is an elevational view of the apparatus with a section thereof broken away to show operational details thereof.
Figure 3:
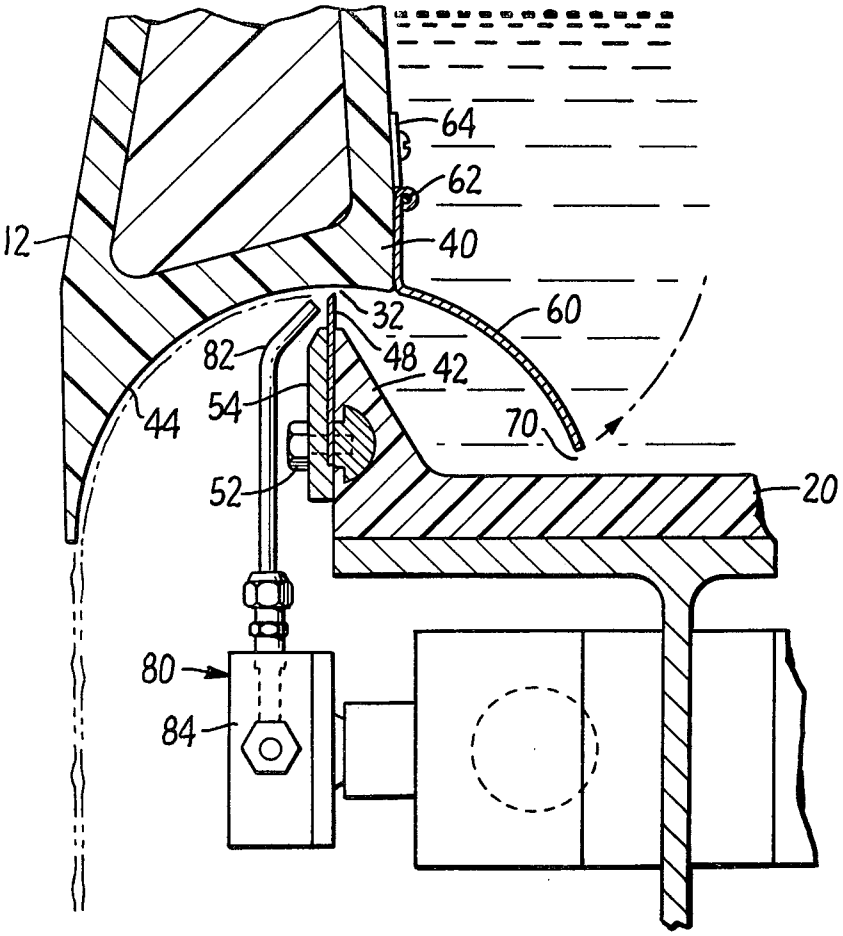
FIG. 3 is an enlarged sectional side view showing selected details of the apparatus.

Referring now to FIGS. 1–3 a preferred form of apparatus constructed in accordance with the teachings of the present invention is illustrated. The apparatus includes a housing generally indicated by reference numeral 10 having side walls 12 and 14, end walls 16 and 18 and a bottom wall 20, all of said walls being secured together through any suitable expedient. The housing walls may be formed of any suitable material such as plexiglass, fiberglass, or the like. In the arrangement illustrated the side walls 12 and 14 are of double wall construction to impart additional strength thereto. The cavity formed by the double wall construction may be filled with plastic foam or other suitable material to impart still further strength.

To insure proper functioning of the present invention the "white water" or other liquid within the housing must be maintained under pressure near the bottom of the housing. This may be accomplished as by means of an open head box construction or, as in the arrangement illustrated, by employing a cover plate 24 on the housing and introducing liquid under pressure into the interior of the housing through a conduit 26 projecting through the cover plate. Tie bars 28 are preferably secured to the side walls in any desired fashion to maintain the structural intregity of the housing under pressure conditions.

Liquid exit apertures in the form of elongated slits 32 and 34 extending along the length of the housing are formed in side walls 12 and 14, respectively. Pressurized liquid within the housing exits through said slits in a generally horizontal direction. Operational details of the structure relating to slit 32 is shown in FIG. 3 wherein it will be noted that side wall 12 is formed of an upper section 40 and a lower section 42, said lower section being formed intregally with bottom wall 20. Upper section 40 is curved at the bottom thereof to provide a curved liquid deflection surface 44 which defines the upper extent of slit 32, said deflection surface leading from said slit to a generally vertical downward direction. The lower end of slit 32 is defined by a plate 48 which may be formed of stainless steel or the like. Suitable connector means 52 in conjunction with a lock plate 54 may be utilized to secure plate 48 to side wall lower section 42 in such a manner that plate 48 may be selectively adjusted relative thereto. It will be appreciated that in the arrangement disclosed the velocity head is utilized to generate centrifugal forces which keep the liquid sheet exiting from slit 32 attached to the under side of curved deflection surface 44.

A baffle 60 in the form a curved plate is attached to side wall upper section 40 as by means of a hinge pin 62 secured to section 40 by attachment plate 64. Baffle 60 extends along the full length of side wall 12 and along with bottom wall 20 defines an opening 70 through which liquid must pass prior to exiting from slit 32. Passage of liquid through opening 70 produces agitation within the liquid and helps to break up any fiber flocks therein. Further dispersion is aided by flow exceleration as the liquid passes through the opening and by the vortex generated in the cusp formed by the curved baffle. Since slit 32 is positioned above bottom wall 20, heavy particles such as sand which may be in the liquid cannot enter the slit but are simply deposited at the bottom of the housing.

Although plugging is greatly alleviated by the present design, it is desirable to provide auxilliary means for cleaning slit 32. In the arrangement of FIGS. 1–3 such cleaning means comprises a movable liquid jet nozzle operatively associated with each slit. FIG. 3 shows operational details of the cleaning nozzle 80 utilized to clean slit 32. Nozzle 80 includes a conduit 82 having the open exit end thereof spaced from deflection surface 44 and directed toward slit 32. At the bottom end thereof conduit 82 is connected to a housing 84 through which fluid flow communication is provided between conduit 82 and any suitable source of high pressure liquid such as water through a movable flexible hose or pipr 86 (FIG. 2). Through any suitable mechanism, pipe 86 and nozzle 80 may be moved in a direction of the arrow shown in FIG. 2 along the full length of side wall 12 so as to direct a high speed jet of water or the like against the slit along the full length thereof. It will be appreciated that cleaning nozzle 80 is normally not in operation and will be actuated as needed at the will of the operator or by a suitable automatic timer mechanism.

It will be further appreciated that the structure associated with slit 34 is identical to that just described with respect to slit 32. A two slit arrangement of the type illustrated in FIGS. 1–3 is preferable to a device wherein a slit is provided within only one side wall. For any desired total discharge volume the two slit arrangement permits narrower slits and thus more stable flow and also requires lower pressure head. In addition, a two slit arrangement improves performance reliability since slight blockage of one slit will not necessarily result in failure of overall felt coverage.

Any suitable arrangement may be employed for mounting the housing 10 over the felt or other target surface. In the arrangement of FIGS. 1–3 an I-beam 90 is employed. Drip guards 92 and 94 are preferably attached to the bottom of I-beam as shown so that they are positioned below slits 32 and 34.

Figure 4:
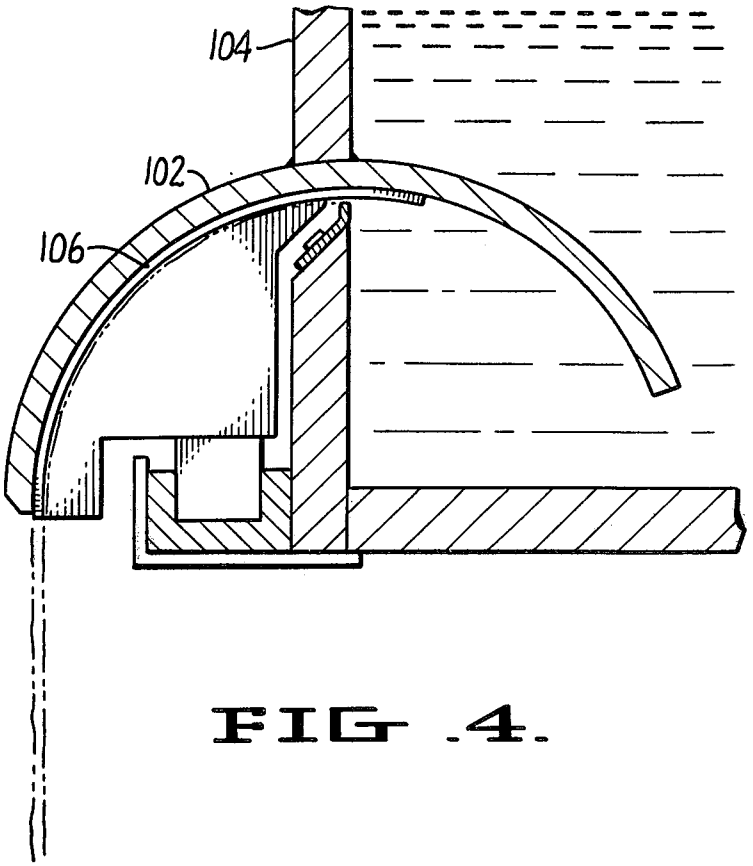
FIG. 4 is a view similar to that of FIG. 3 but illustrating an alternative embodiment of the present invention.

Rather than employ a traversing high pressure water jet to clean the slits of apparatus constructed in accordance with the present invention, a mechanical wiper may be employed. FIG. 4 illustrates one such suitable arrangement wherein a single curved plate 102 secured to side wall upper section 104 forms not only the curved liquid deflection surface but also the baffle disposed inside the housing. A mechanical wiper in the form of a curved finger 106 projects inwardly through the elongated slit and may be caused to traverse said slit through any suitable mechanism. It will be appreciated that cleaner element 106 is normally disposed at one end of its associated housing when not performing a cleaning function.

I claim:

1. Apparatus for uniformly distributing liquid to the surface of a moving web, said apparatus comprising a housing having side walls and a bottom wall, said housing being disposed above said surface and having an interior accommodating said liquid, at least one of said side walls having an upper wall section having a curved bottom end and a lower wall section having a narrow top end, said ends spaced from one another to define an elongated narrow slit extending across said web surface and positioned above said bottom wall, said curved bottom end extending from the housing interior over said narrow top end and at least partially defining a curved liquid deflection surface extending from said elongated narrow slit externally of said housing interior and adapted to direct liquid exiting in a generally horizontal direction from said housing interior through said exit slit downwardly toward said web surface in a thin stream conforming to the dimensions of said elongated narrow slit.

2. The apparatus of claim 1 wherein two elongated narrow slits are formed in said housing in two parallel side walls thereof whereby liquid is distributed to said web surface at two locations.

3. The apparatus of claim 1 additionally comprising cleaning means positioned externally of said housing and selectively positionable along said slit, said cleaning means adapted to dislodge material in said slit and direct said material into said housing interior.

4. The apparatus of claim 3 wherein said cleaning means comprises a movable jet nozzle for directing a high pressure liquid jet into said slit.

5. The apparatus of claim 1 additionally including a curved baffle plate in said housing interior comprising an extension of said upper wall section curved bottom end.

6. The apparatus of claim 1 wherein said narrow slit defining top end of said bottom wall section comprises an adjustable thin plate.

* * * * *